US007343990B2

(12) United States Patent
Pessier et al.

(10) Patent No.: US 7,343,990 B2
(45) Date of Patent: Mar. 18, 2008

(54) ROTARY ROCK BIT WITH HARDFACING TO REDUCE CONE EROSION

(75) Inventors: Rudolf C. Pessier, The Woodlands, TX (US); James L. Overstreet, Tomball, TX (US); Russell S. Nibogie, Edmonton (CA); Robert J. Buske, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/449,175

(22) Filed: Jun. 8, 2006

(65) Prior Publication Data

US 2007/0284151 A1 Dec. 13, 2007

(51) Int. Cl.
*E21B 10/08* (2006.01)

(52) U.S. Cl. ..... 175/374; 175/341; 175/375

(58) Field of Classification Search ..... 175/375, 175/374, 341, 331

See application file for complete search history.

(56) References Cited

U.S. PATENT DOCUMENTS

| | | | | |
|---|---|---|---|---|
| 4,597,456 | A | 7/1986 | Ecer | |
| 5,348,770 | A * | 9/1994 | Sievers et al. | 427/422 |
| 6,138,779 | A * | 10/2000 | Boyce | 175/374 |
| 6,253,862 | B1 | 7/2001 | Overstreet et al. | |
| 6,766,870 | B2 * | 7/2004 | Overstreet | 175/374 |
| 2001/0015290 | A1 | 8/2001 | Sue et al. | |

* cited by examiner

*Primary Examiner*—David Bagnell
*Assistant Examiner*—Giovanna M Collins
(74) *Attorney, Agent, or Firm*—Bracewell & Giuliani LLP

(57) ABSTRACT

An earth-boring bit has a body with three bit legs. A cone is rotatably mounted to each of the bit legs. Each of the cones has an outer row and an inner row of teeth machined on it. Each of the teeth has a rectangular root with inner, outer and lateral boundaries. A layer of hardfacing is applied to each tooth and on an exterior portion of each of the cones surrounding the inner, outer and lateral boundaries of each of the teeth. Conical surfaces between the inner and outer rows contain at least portions of the hardfacing.

16 Claims, 3 Drawing Sheets

ROTARY ROCK BIT WITH HARDFACING TO REDUCE CONE EROSION

FIELD OF THE INVENTION

This invention relates in general to earth-boring bits having rotating cones with milled teeth and in particular to hardfacing on the cone shells to reduce erosion.

BACKGROUND OF THE INVENTION

An earth boring bit of the type concerned herein has a bit body with three depending bit legs. A rolling cone or cutter is rotatably mounted to each bit leg. Each cone comprises a steel shell having a plurality of rows of milled teeth formed in the cutter shell by machining. To reduce wear, the teeth and gage surface are hardfaced with a hardfacing that is typically tungsten carbide in an alloy steel matrix. Also, it is known to place hardfacing at the spear point area of the cone. The remaining portions of the cones are left free of hardfacing in the prior art.

While drilling, particularly in unconsolidated, highly abrasive sand formations, the cutting structure and cone shell are subjected to the abrasive cuttings being drilled, the high sand content in the mud, and the sand particles that remain on the borehole bottom due to poor rig hydraulics and/or horizontal drilling. All of these factors cause wear on the teeth and erosion on the shell of the cones. Even if the drilling flow rate or rig hydraulics is high enough to flush sand particles from the borehole bottom, the high flow rate of the mud discharged through the nozzles can cause the teeth and cone shell to be eroded prematurely.

Many operators use center-jet nozzles to help with the cone cleaning. This constant impingement of abrasive drilling fluid exiting the center-jet nozzles can cause abrasive and erosive wear that will substantially damage the base of the teeth and cone shell. This damage will undermine the individual teeth and eventually may cause them to break off. The hardfacing protection of the prior art only offers partial reduction of abrasive and erosive wear.

SUMMARY OF THE INVENTION

In this invention, in addition to a layer of hardfacing on the teeth and gage surface, the valleys between the teeth are hardfaced. Hardfacing is also located at least partially on the conical bands between the rows. The hardfacing completely surrounds the perimeter or boundaries of the root of each tooth.

An annular bead or strip of the hardfacing is located on the conical band at the inner edges of the outer rows. Another bead or strip of hardfacing is located on outer edges of the inner rows. If sufficiently wide, the conical band between the inner and outer rows will have a smooth portion free of the hardfacing.

An annular bead of the hardfacing is located on the inner edges of the inner rows. This bead of hardfacing will extend at least partially over the conical surface leading to the apex of the cone. If the conical surface is sufficiently wide, a portion may remain smooth and free of the hardfacing. The hardfacing may be of a variety of types, and preferably comprises tungsten carbide particles in a matrix selected from a group consisting of iron, cobalt, nickel and alloys thereof.

DETAILED DESCRIPTION OF THE INVENTION

Figure 1:
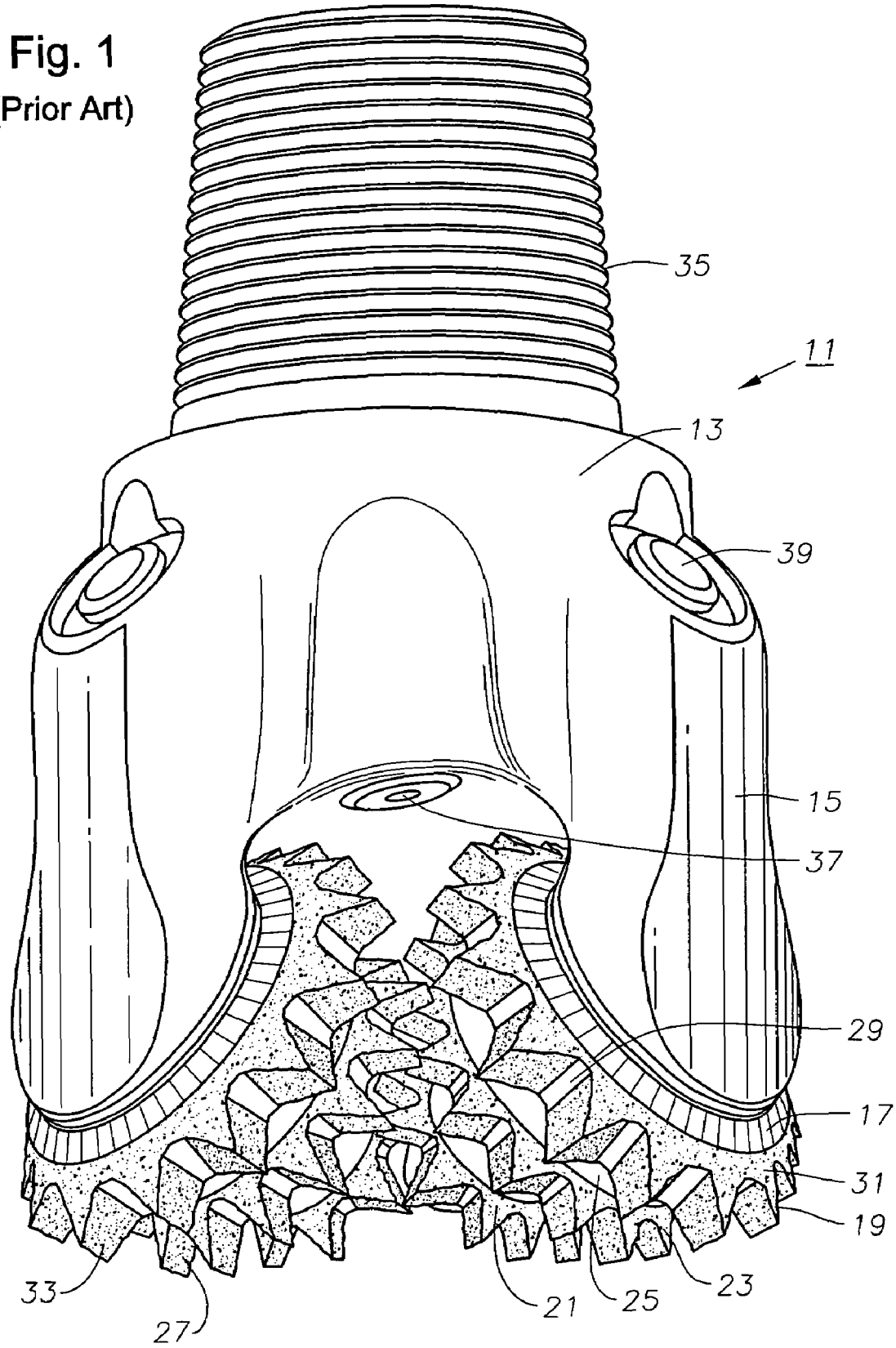
Fig. 1 (Prior Art)
FIG. 1 is a side elevational view of an earth-boring bit having hardfacing in accordance with a prior art pattern.

Referring to FIG. 1, bit 11 illustrates a conventional earth-boring bit, having a body 13 with three bit legs 15 depending therefrom. A cone 17 is rotatably mounted to each of the bit legs 15. Each cone 17 is formed of a steel shell or body. Each cone 17 of bit 11 has three rows of teeth 27, including an outer row 19, an inner row 21 and an intermediate row 23. However, it is common for cones 17 to have different numbers of rows, such as only two rows. A conical band 25 is located between the rows 19 and 21 and the rows 21 and 23.

The teeth 27 within each row 19, 21 and 23 are milled or machined from the body of cone 17. Each tooth 27 is separated from adjacent teeth in the same row by a valley 29. The base of valley 29 may be concave or U-shaped, as shown. Alternately, the base of each valley 29 may be convex if teeth 27 in a particular row are spaced far enough apart from each other. Outer rows 19 are located closest to a gage surface 31 that defines the diameter of the bit and the borehole.

In the prior art, a layer of hardfacing 33 is applied over the flanks of each tooth 27 in each of the rows 19, 21 and 23 and on gage surface 31. However, hardfacing 33 is not located on the conical bands 25 between the rows 19, 21 or 23 and not located in the bases of valleys 29. The portion of the cone shell surrounding the root of each tooth 27 remains smooth and free of hardfacing in the prior art.

Prior art bit 11 has a threaded section 35 at its upper end for connection to a drill string. Bit 11 has a drilling fluid passage within it that leads to a plurality of nozzles 37 for discharging drilling fluid. A lubricant reservoir supplies lubricant to the bearing spaces of each cone 17, and a pressure compensator 39 equalizes the lubricant pressure with the borehole fluid pressure on the exterior.

Figure 2:
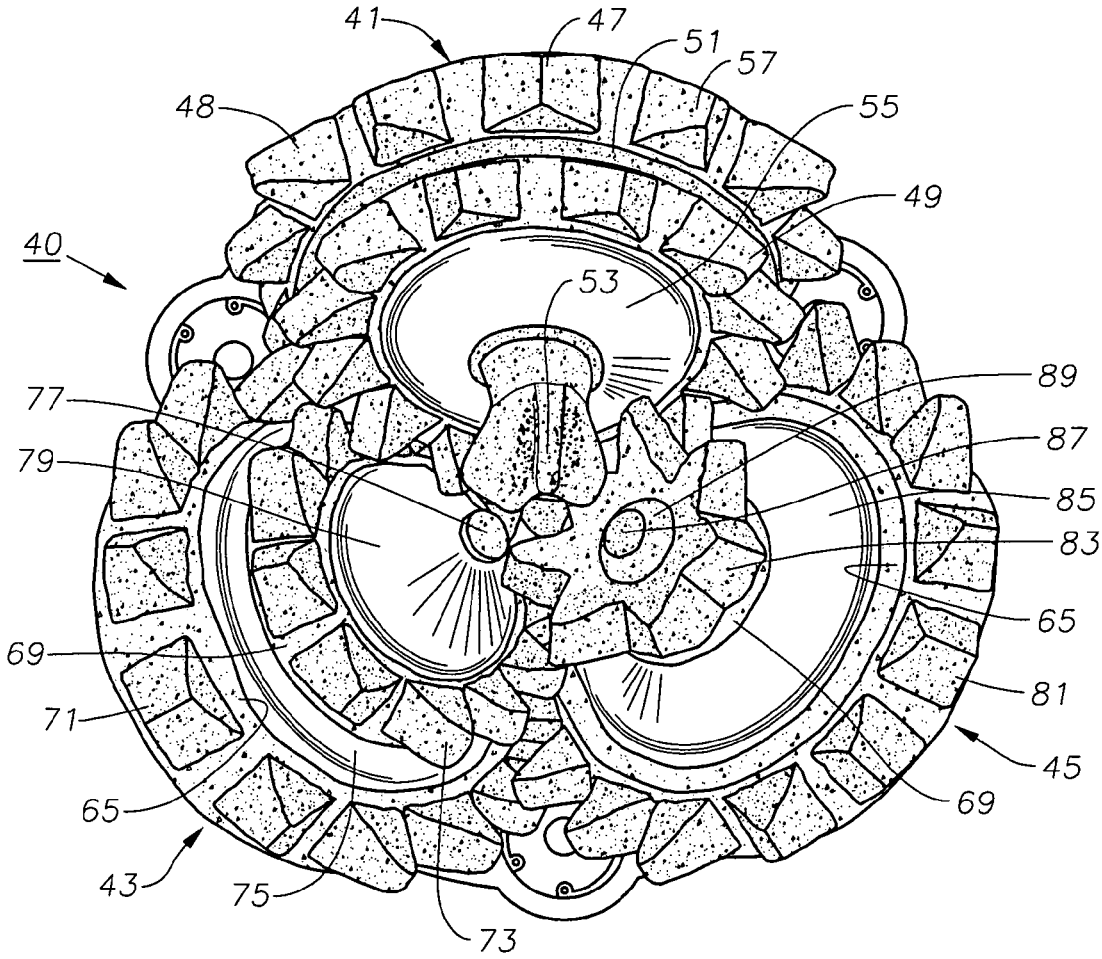
FIG. 2 is a bottom view of an earth-boring bit having cones hardfaced in accordance with this invention.

Referring to FIG. 2, bit 40 of this invention has a body, bit legs, pressure compensators and a threaded section that are not shown but may be the same as in prior art bit 11 of FIG. 1. Bit 40 has a first cone 41, a second cone 43, and a third cone 45. Each cone 41, 43 and 45 has a plurality of teeth 48 milled from the cone shell and located in various annular rows. In this example, each cone 41, 43 and 45 has only two rows of teeth 48, but that number could vary.

First cone 41 has an outer row 47 of teeth 48, which are located adjacent the gage surface of first cone 41. An inner row 49 is located a short distance inward from outer row 47 toward the bit axis. A thin annular conical band 51 is located between outer and inner rows 47, 49. First cone 41 has a spear point 53 on its apex. Spear point 53 is conventional and comprises radially extending blades. A wide conical surface 55 extends from inner row 49 to the neck portion of spear point 53.

A layer of hardfacing 57 is applied to teeth 48 of outer row 47, inner row 49 and conical surface 55 located between them. Hardfacing 57 is also located in the valleys between the individual teeth 48 in each row 47, 49. In addition, hardfacing 57 is located conventionally on the gage surface as well as on spear point 53. Most of the conical surface 55 between spear point 53 and inner row 49 is smooth and free of hardfacing 57.

Hardfacing 57 may be the same type as used in the prior art, this being primarily tungsten carbide particles or granules in a matrix selected from a group consisting of iron, cobalt, nickel and alloys thereof. The hardfacing particles may be cemented tungsten carbide, cast tungsten carbide, macrocrystalline tungsten carbide, or mixtures thereof. The composition of hardfacing 57 is preferably uniform on the various portions of first cone 41, but it could differ from one portion of cone 41 to another portion of first cone 41. Hardfacing 57 is preferably applied by an oxy-acetylene torch, wherein a technician uses the torch to melt a steel tube containing particles of tungsten carbide. Other methods of application are feasible.

Figure 3:
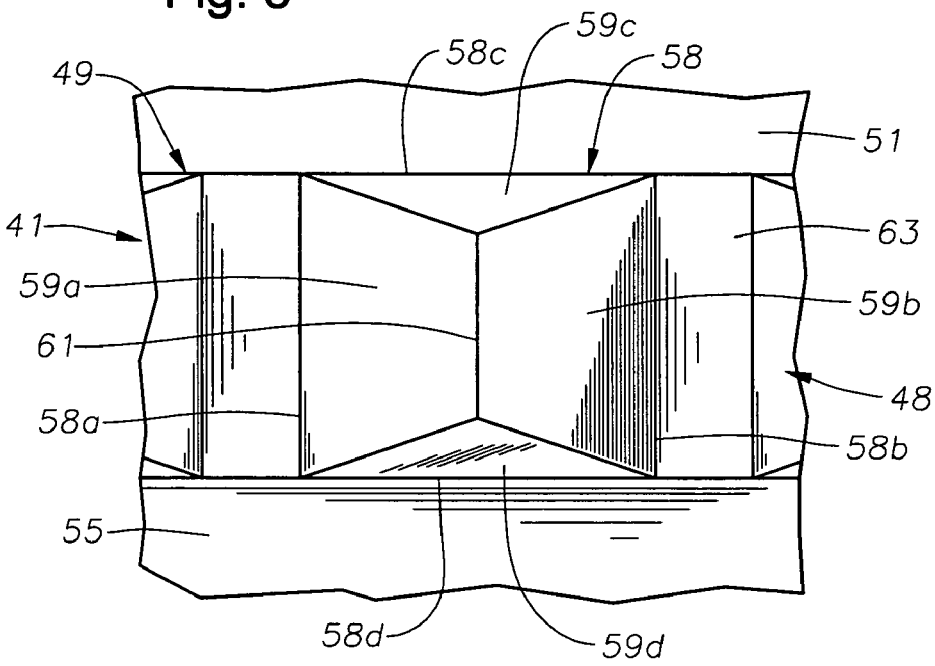
FIG. 3 is a plan view of a portion of the inner row on one of the cones of the bit of FIG. 2, and shown prior to applying hardfacing.

FIG. 3 shows prior to applying hardfacing 57, one tooth 48 and portions of two adjacent teeth 48 for inner row 49 of first cone 41. Each tooth 48 has a generally rectangular root 58, which comprises the base portion that adjoins the shell of first cone 41. Root 58 has a rectangular perimeter comprising two lateral boundaries or margins 58*a* and 58*b*, an outer margin 58*c* and an inner margin 58*d*. Outer margin 58*c* adjoins conical band 51, while inner margin 58*d* adjoins conical surface 55. Each tooth 48 has lateral flanks 59*a* and 59*b* that converge upward to a crest 61, which comprises a straight line ridge parallel with lateral margins 58*a*, 58*b*. Inner and outer end surfaces 59*c* and 59*d* also converge upward to crest 61. A valley 63 is located between each tooth 48 in row 49. Valley 63 may have a U-shaped base or it may be rounded in a slightly convex manner.

Figure 4:
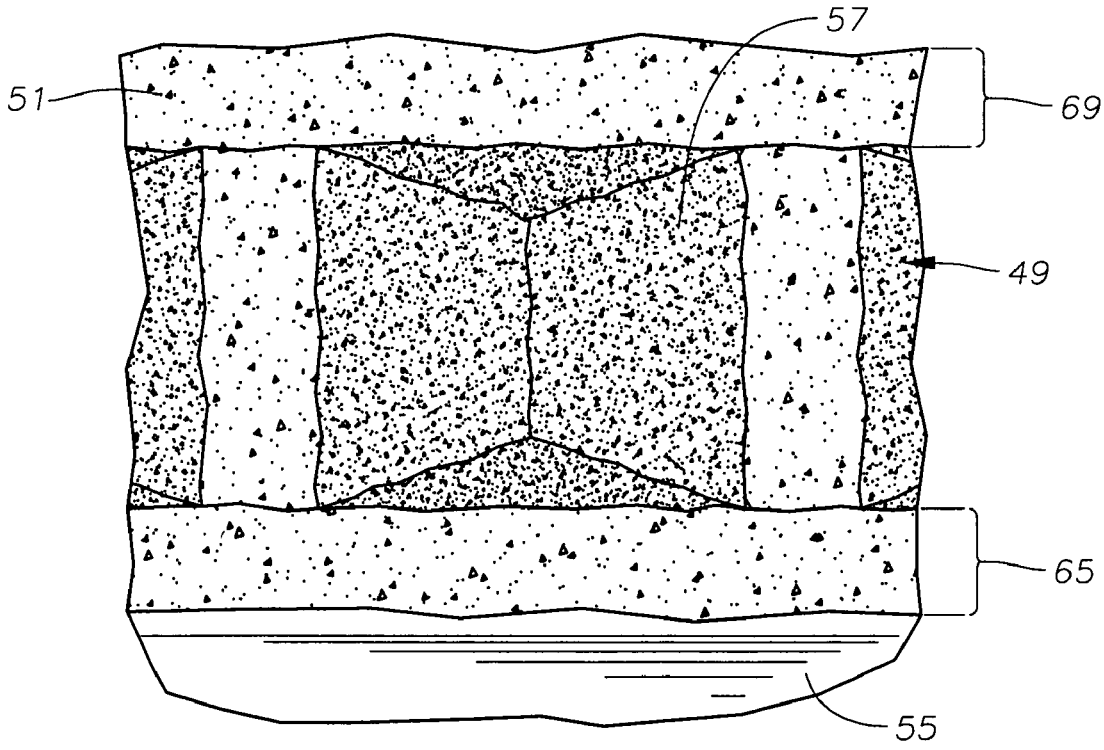
FIG. 4 is a view of the tooth shown in FIG. 3, after hardfacing has been applied.

Referring to FIG. 4, after application, hardfacing 57 completely overlies each tooth 48, covering flanks 59*a*, 59*b*, 59*c* and 59*d*. Also, hardfacing 57 completely covers valleys 63. In addition, an inner boundary strip or bead 65 of the hardfacing overlies root inner margin 58*d* and outer edge portion of conical surface 55. Inner boundary strip 65 is annular, thus extends completely around first cone 41. The width of inner boundary strip 65 is preferably the width of a typical weld bead, which may be in the order of about ¼". Inner boundary strip 65 thus not only covers inner root margin 58*d* but also up to about ¼" of conical surface 55.

Additionally, an outer boundary strip or bead 69 overlies root outer margin 58*c* and over an inner portion of conical band 51 in the same manner. Outer boundary strip 69 is also annular, extending completely around first cone 41. In this embodiment, because of the close spacing of inner and outer rows 49, 47, outer boundary strip 69 extends completely to first cone outer row 47 (FIG. 2), thus completely overlies conical band 51.

Referring again to FIG. 2, second cone 43 has an outer row 71 and an inner row 73 separated by a conical band 75. Conical band 75 is wider than conical band 51 of first cone 41 in this embodiment. Hardfacing 57 is applied to teeth 48 in the same pattern as shown in FIGS. 3 and 4. However, because of the greater width of conical band 75 than first cone conical band 51, a central portion of second cone conical band 75 remains smooth and free of any hardfacing 57, as shown in FIG. 2. Inner row 73 has an outer boundary hardfacing bead 69 that is located on the inner edge portion of conical band 75. Also, second cone outer row 71 has an inner boundary hardfacing bead 65 that is located on an outer edge portion of conical band 75.

Second cone 43 has a blunt apex 77 that is separated from inner row 73 by a conical surface 79. In this embodiment, a layer of hardfacing 57 is deposited in the form of a generally flat disc on apex 77. Second cone inner row 73 has an inner annular boundary strip 65 of hardfacing 57 that is located on an outer edge portion of conical surface 79. The remaining portion of conical surface 79 between apex 77 and inner hardfacing strip 65 of inner row 73 is smooth and free of any hardfacing 57. Conical surface 79 is narrower than conical surface 55 of first cone 41 in this embodiment.

Third cone 45 has an outer row 81 and an inner row 83 separated by a conical band 85. Conical band 85 is wider than second cone conical band 75 in this embodiment. In the same manner as with the other cones, outer row 81 has an inner boundary hardfacing strip 65. Third cone outer row 81 has an inner boundary hardfacing strip 65, and third cone inner row 83 has an outer boundary hardfacing strip 69. Inner and outer boundary strips 65, 69 overlie outer and inner edge portions of conical band 85 with the remaining portion of conical band 85 remaining free of any hardfacing. Third cone 45 has an apex 87 that is separated by a thin conical surface 89 from inner row 83. In this embodiment, hardfacing 57 extends over apex 87 as well as the entire conical surface 89.

In operation, bit 40 is run conventionally. The additional areas of hardfacing 57 reduce wear and erosion on the teeth and cone shells. The surrounding beads or strips of hardfacing around each tooth 48 reduce cone shell erosion, thus extending the lives of the teeth.

While the invention has been shown in only one of its forms, it should be apparent to those skilled in the art that it is not so limited but is susceptible to various changes without departing from the scope of the invention.

The invention claimed is:

1. An earth boring bit, comprising:

a body having three bit legs;

a cone rotatably mounted to each of the bit legs, each of the cones having a plurality of rows of teeth formed thereon, each tooth being separated from an adjacent tooth by a valley, each of the rows being separated from an adjacent row by an annular conical band;

a layer of hardfacing on each of the teeth, in the valleys between the teeth, and at least partially on the bands between the rows, the hardfacing comprising tungsten carbide particles in a matrix selected from a group consisting of iron, cobalt, nickel and alloys thereof; wherein the conical band on at least one of the cones comprises:

an outer edge portion containing a continuous annular strip of the hardfacing;

an inner edge portion containing a continuous annular strip of the hardfacing; and a continuous annular central portion between the inner and outer edge portions that is smooth and free of the hardfacing.

2. The bit according to claim 1, wherein:

the rows of teeth on each of the cones comprise an outer row and an inner row separated by the conical band;

each of the cones has an a conical surface on an inner side of the inner row; and the layer of hardfacing extends at least partially over the conical surface.

3. The bit according to claim 1, wherein:

the conical band on at least one other of the cones is entirely covered with the hardfacing.

4. The bit according to claim 1, wherein:

the conical band on another one of the cones is entirely covered with the hardfacing.

5. The bit according to claim 1, wherein:

each of the teeth has a rectangular root, the root having a perimeter; and a bead of the hardfacing overlies and extends past the perimeter of the root of each of the teeth.

6. The bit according to claim 1, wherein each of the cones has an apex portion that contains a layer of the hardfacing.

7. An earth boring bit, comprising:

a body having three bit legs;

first, second, and third cones rotatably mounted to the bit legs, each of the cones having an outer row and an inner row of teeth integrally formed thereon, each of the teeth of the inner row of each of the cones having a rectangular root with inner, outer and lateral boundaries;

a layer of hardfacing on each of the teeth of the inner row and on an exterior portion of each of the cones surrounding the inner, outer and lateral boundaries of each of the teeth of the inner row, the hardfacing comprising tungsten carbide particles in a matrix selected from a group consisting of iron, cobalt, nickel and alloys thereof; and wherein the lateral boundaries of the roots of the teeth of the inner row of each of the cones comprise valleys, and each of the valleys being completely covered by the hardfacing wherein annular inner and outer conical surfaces that are smooth and free of the hardfacing join the hardfacing at the inner and outer boundaries, respectively, of the roots of the teeth of the inner row of at least one of the cones.

8. The bit according to claim 7, wherein the third cone has an apex and the hardfacing extends continuously over the inner row, the apex and a conical space between the inner row and the apex of the third cone.

9. The bit according to claim 7, wherein:

each of the cones has an apex containing a layer of the hardfacing.

10. The bit according to claim 7, wherein the outer and inner rows of the second and third cones are separated from each other by annular conical surfaces that have central portions that are smooth and free of the hardfacing.

11. An earth boring bit, comprising:

a body having three bit legs;

first, second, and third cones rotatably mounted to the bit legs, each of the cones having an outer row and an inner row of teeth integrally formed thereon, each of the teeth of the inner row of each of the cones having a rectangular root with inner, outer and lateral boundaries;

a layer of hardfacing on each of the teeth of the inner row and on an exterior portion of each of the cones surrounding the inner, outer and lateral boundaries of each of the teeth of the inner row, the hardfacing comprising tungsten carbide particles in a matrix selected from a group consisting of iron, cobalt, nickel and alloys thereof; and wherein the outer and inner rows of the first cone are separated from each other by an annular conical band that is entirely overlaid with the hardfacing wherein the outer and inner rows of the second and third cones are separated from each other by annular conical surfaces that have central portions that are smooth and free of the hardfacing.

12. An earth boring bit, comprising:

a body having three bit legs;

first, second, and third cones rotatably mounted to the bit legs, each of the cones having an outer row and an inner row of milled teeth, each of the outer and inner rows being separated from each other by an annular conical band, the conical band of the first cone being smaller in width than the conical band of the second cone, and the conical band of the second cone being smaller in width than the third cone;

a layer of hardfacing on each of the teeth of the outer and inner rows of each of the cones;

a layer of hardfacing also overlying valleys between each of the teeth of the inner and outer rows of each of the cones;

a layer of hardfacing also overlying the entire conical band of the first cone; and a layer of hardfacing also overlying inner and outer margins of the conical bands of the second and third cones, with central portions of the conical bands of the second and third cones being free of any hardfacing; and wherein each of the layers of hardfacing comprises tungsten carbide particles in a matrix selected from a group consisting of iron, cobalt, nickel and alloys thereof.

13. The bit according to claim 12, wherein:

the first cone has a bladed spear point containing a layer of the hardfacing;

the inner row of the first cone and the spear point are separated from each other by an annular conical surface;

the conical surface of the first cone contains an annular continuous strip of hardfacing where it adjoins the inner row; and the conical surface of the first cone is smooth and free of any hardfacing between the annular strip and the layer of hardfacing on the spear point.

14. The bit according to claim 12, wherein:

the second cone has an apex and an annular conical surface extending from the inner row to the apex;

the conical surface of the second cone contains an annular continuous strip of hardfacing where it adjoins the inner row; and the conical surface of the second cone is smooth and free of any hardfacing between the annular strip and the apex.

15. The bit according to claim 14, wherein:

a layer of hardfacing overlies the apex.

16. The bit according to claim 12, wherein:

the third cone has an apex and an annular conical surface extending from the inner row to the apex; and the conical surface of the third cone and the apex are overlaid entirely by a layer of hardfacing.

* * * * *